United States Patent [19]

Hickson et al.

[11] 4,304,174

[45] Dec. 8, 1981

[54] SEGMENTED PANEL CURTAIN OPENING CLOSURE

[75] Inventors: Jeffrey D. Hickson, Sharon; Robert S. Dworkin, Cambridge, both of Mass.

[73] Assignee: Entropy Controls, Inc., Milford, Mass.

[21] Appl. No.: 108,949

[22] Filed: Dec. 31, 1979

[51] Int. Cl.[3] ..... F24F 7/06; A47H 13/01

[52] U.S. Cl. ..... 98/33 A; 160/126; 160/184; 160/330; 160/DIG. 16

[58] Field of Search ..... 98/32, 33 R, 33 A, 42 R, 98/43 R, 88 R, 90, 94 R, 96; 160/126, 123, 130, 184, 181, 196 R, 330, 382, 385, 383, 399, 402, 403, DIG. 16; 126/901; 248/206 A

[56] References Cited

U.S. PATENT DOCUMENTS

| | | | |
|---|---|---|---|
| 3,170,714 | 2/1965 | Stalker | 160/DIG. 16 |
| 3,254,698 | 6/1966 | Fox et al. | 160/184 |
| 3,331,425 | 7/1967 | Groves et al. | 160/126 |
| 3,529,653 | 9/1970 | Fey, Jr. | 160/402 X |
| 3,592,256 | 7/1971 | Knight | 160/184 |
| 4,020,826 | 5/1977 | Mole | 126/901 |
| 4,184,415 | 1/1980 | Nicholson | 98/33 A |

FOREIGN PATENT DOCUMENTS

| | | | |
|---|---|---|---|
| 542547 | 11/1955 | Belgium | 160/123 |
| 2134778 | 1/1972 | Fed. Rep. of Germany | 98/33 A |
| 798497 | 7/1958 | United Kingdom | 160/385 |

*Primary Examiner*—Albert J. Makay
*Assistant Examiner*—Harold Joyce
*Attorney, Agent, or Firm*—William Nitkin

[57] ABSTRACT

An improved opening closure system utilizing a plurality of curtains supported in a way to cover the opening with alternate embodiments having primary and secondary curtains acting as a thermal siphon and with fan units as a power air destratifier.

11 Claims, 10 Drawing Figures

SEGMENTED PANEL CURTAIN OPENING CLOSURE

BACKGROUND OF THE INVENTION

1. Field of the Invention

The apparatus of this invention relates to closure members and more particularly to a segmented panel curtain opening closure.

2. History of the Prior Art

Closures for doors and the like consisting of a plurality of strips of curtain-like material disposed adjacent to one another in a doorway or other opening are currently in use. One may pass therethrough between the members of the curtains pushing them to the side to gain access to the other side of the closure. Such closures may be found in garages wherein they are utilized to retain heat within the building while still allowing vehicles to pass freely in and out. As vehicles pass through, they cause the curtain segments to separate and pass therearound and then after passage, they fall back into place side by side to one another reclosing the opening. Such closures may also be utilized for example in freezer cases to allow access to contents without utilizing doors in order to retain the low temperature within the case. In such cases, one may utilize a series of thin strips of transparent curtain-like material between which one can insert one's hand to gain access therein.

SUMMARY

It is an object of this invention to provide a new and improved segmented panel curtain opening closure system which in its various embodiments herein disclosed can be utilized to improve the thermal efficiency of the building or place where they are installed.

It is a further object of this invention to allow for light transmittability and visibility therethrough of the closure curtains by utilizing transparent material. The outside panels could also be tinted of a different color to assist in the aiming of the vehicles that may pass therethrough. The light transmittability and transparency of the plastic is approximately 90%.

The basic structure of this invention is comprised of an angle iron beam member with its angle pointed in an upward direction. The angle iron is suspended by bolts from a ceiling or other upward portion of the open area. Flexible plastic sheets are disposed along the angle iron member extending from its front over its top, around its other side and are attached thereto by a series of magnets to the rear inside portion of the angle iron. This structure helps to support the plastic sheets because of the weight distribution of the sheets which are disposed both on the front, top, rear and around to the inside rear portions of the angle iron. The use of magnets is advantageous should the plastic sheets be caught as they will release without permanent damage to the unit and they can be easily reattached. The use of magnets in the fashion as described herein yields a controlled release which is an object of this invention. Although the above described method of attachment is preferred, other methods of attachment can be utilized, for example, having the angle of the angle iron face in a downward position with the magnets merely attached around the front upper lip of the angle.

It is still a further object of this invention to utilize a series of curtains in various rows to form thermal siphons as will be discussed below. The arrangement of the curtains on the angle iron attachment is critical for the proper utilization of the structure of this invention especially with regard to its utilization in automotive traffic areas. For example, in a typical garage opening which is approximately 10 ft. by 10 ft., strips can be provided to be suspended on an angle iron that may be somewhat longer than 10 ft. to allow for the attachment members to hold it to the ceiling area. Such curtain members can have outer curtains of 36" width and a series of two 27" inner curtains which overlap one another at the center and overlap approximately 3" on the front side of the 36" curtains. Then two 18" curtains are disposed in front of the junction of the 27" curtain and the 36" curtain. It has been found that this arrangement of curtains ideally suits the passage of vehicular traffic and yet still resists the considerable forces of wind and weather. The magnets can be disposed at the top of each curtain, and cutout sections can be provided so as to avoid triple overlapping of magnets on the angle irons. Such cutouts may remove a section, for example, of the 36" magnet so that it may be overlapped by the 27" magnet strip attached to the 27" sheet. One of the 27" sheet magnets can have a similar cutout to accommodate the overlap of the other 27" magnet strip on the other 27" sheet while the 18" strips can overlap the juncture of the 27" and 36" strips.

One can dispose a secondary curtain member 8"–9" behind the first primary curtain. This secondary curtain can extend to 2 ft.–3 ft. above the floor surface and the top of which can also be positioned slightly lower than the top of the primary curtain. The dual curtains act as a thermal siphon. In a garage, for example, hot air passes down between the two, cooled by the cold inner surface of the primary curtain. The somewhat cooled air drops down to the floor and passes under the secondary curtain into the garage work area where it may be still warmer than the interior air of the garage at that level. The secondary curtains also act as additional wind resistance and as further insulation from outside cold air. The passive air circulation between the primary and secondary curtains can raise the interior temperature of the floor area of the garage by approximately 1.5 degrees F. and will destratify the air thereby reducing the temperature gradient from the ceiling to the floor of the area in which the apparatus of this invention is used. This thermal siphon can be further modified to be a power destratifier by installing one or more blower members at the top of the junction formed between the primary and secondary curtains. This forcefully blows the air downward and can be thermostatically controlled. For example, when the temperature of a first thermostat located at the bottom of the area and a second thermostat located at the top of the area differ by a certain amount, the blower fans will be activated and will blow the warm air between the primary and secondary curtains down to the floor of the area back under the secondary curtain thereby raising the temperature at the floor and tending to equalize the temperatures which temperature would be sensed by the thermostats causing deactivation of the blower fans. This sequence would occur in a garage, for example, when a car would be driven into the garage or might be activated by a door switch opening and closing to allow a vehicle to enter or leave the area. Further, if a door is utilized on the structure where the apparatus of this invention is installed, when the door is opened, the blower fans create a positive pressure behind the primary curtain thereby offsetting any inward pressure from wind on the outside of the primary curtain thereby reducing its inward deflection or other separation and reducing the amount of cold air that might otherwise enter through separations in the strip members of the curtains. It should be noted that the destratification system or the thermal siphon system utilizing the primary and secondary curtain can be reversed in the summertime by putting the secondary curtain in front of the primary curtain thereby exhausting hot air from the ceiling of the building to the outside of the building thereby lessening heat buildup within the building.

The curtain members may be additionally held together by a series of magnetic latches inserted approximately at the 6 ft.–7 ft. level utilizing thin a flexible magnetically attractive sheet positioned on one sheet of the curtain and an adhesive flexible magnet positioned on the opposite portion of an overlying curtain, so that if they were separated by force, when the curtains came back together, they would be retained by the magnetic latches in the closed position. In another embodiment the magnetically attractive sheet and the magnetic strip can extend the length of the curtains. Further, the curtains tend to adhere to one another when they are manufactured of a 20 mil vinyl, 3s hand grade. This adherence of the vinyl to itself in addition to the layered approach to the curtain segments as discussed above assist in preventing wind from passing between the sheets of the curtain material.

Another embodiment when utilizing a secondary curtain is to have portions thereof of equal 27" width either not significantly overlapping one another or not overlapping at all. Channels may be cut in the next to outermost portions thereof to allow the warm air to pass into the area on either side of the vehicle. This avoids the directing of warm air under the car where it would melt snow or slush adhering to the bottom of the vehicle and where it would also move the mass of cold air settling downward from the body of the vehicle.

Another embodiment of the device of this invention can be utilized, for example, on freezer cabinets within stores wherein the plastic strips can be adjacent to one another and be magnetically attached to a base plate carrying a top serated edged magnet. The serated edge on the top of the base plate magnet can be adapted to mate with a serated magnet affixed to the plastic strips. This mating of the serated edges will prevent lateral movement yet still allow one to place his hands through the strips to retrieve objects inside. Once the hand is removed, the strips come together preventing escape of cold air. The curtains may be separated a short distance to allow inward air circulation to prevent icing and condensation on freezer coils. Such curtains made of black or red translucent material can be used in a darkroom entrance for the purpose of controlling light as well as heat.

DESCRIPTION OF THE PREFERRED EMBODIMENT(S)

Figure 1:
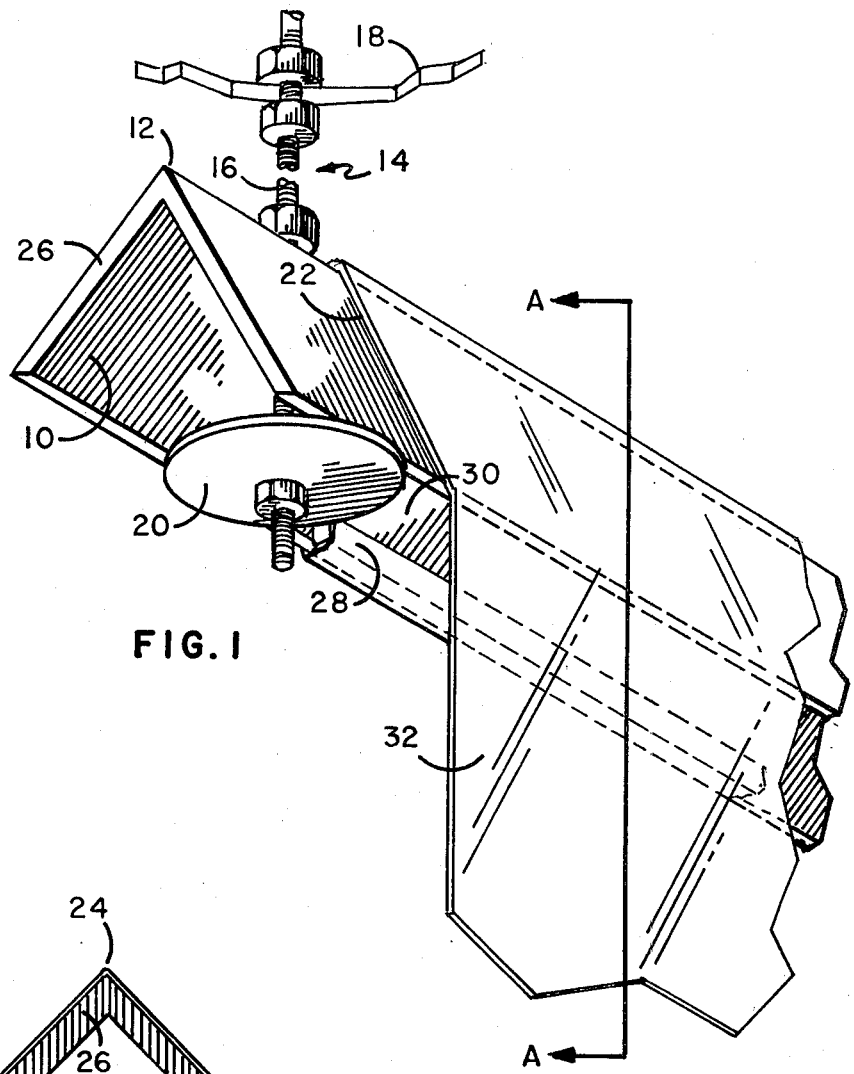
FIG. 1 illustrates a sectional perspective view of the angle iron and support member with plastic sheet passing thereover.

FIG. 1 shows a sectional view of angle iron 10 with its crown 12 pointed in an upward direction with attachment means 14 consisting of elongated threaded rod 16 affixed to ceiling 18 or other equivalent member above the door entrance. Angle iron 10 is usually disposed within a few inches of the walls on either side of the doorway, and extends in length at least to the width of the doorway and preferably longer since the attachment means 14 is affixed along some of the length. A large washer 20 is shown extending to either side of the angle iron and helps prevent angle iron 10 from twisting. Curtain 32 is seen overlaying front portion 22, extending over top portion 24 and around rear portion 26 and affixed by magnets 28 to the inside rear portion 30 of angle iron 10. It should be noted that curtain 32 as shown is transparent although other colored plastic sheeting could be used.

Figure 2:
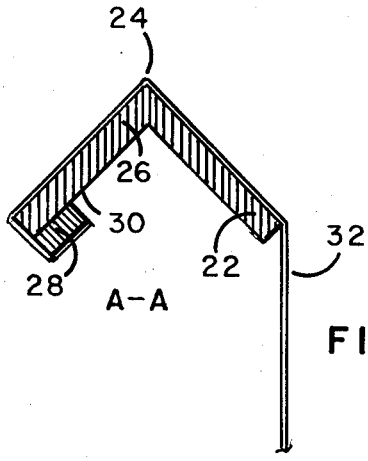
FIG. 2 is a cross-sectional view through Secti

FIG. 2 illustrates a cross-sectional view through Section A—A of FIG. 1 showing front portion 22, top portion 24, rear portion 26 of the angle iron helping to support curtain 32 along with the primary support provided by magnet 28 affixed to the inside rear portion of the angle iron. Curtain 32 is releasable if sufficient force is placed thereon without damage to the system. If magnet 28 releases, the curtain will fall, but it can easily be replaced by putting it back over the angle iron and reaffixing magnet 28 in the proper position.

Figure 3:
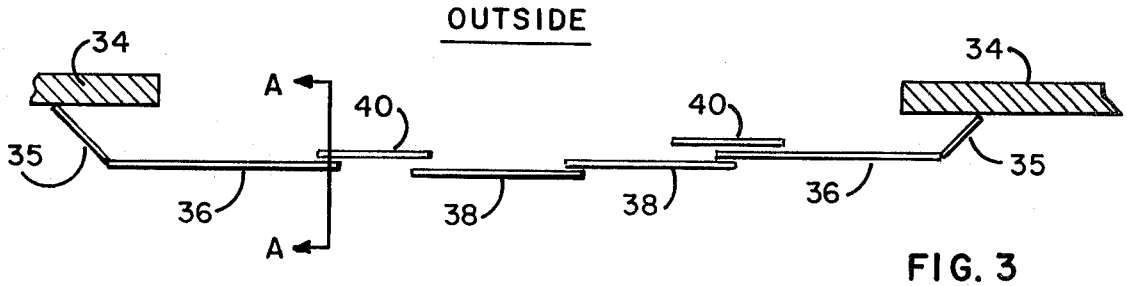
FIG. 3 is a top view of the arrangement of sheets of the primary curtain.

FIG. 3 shows a top view of the overlapping of the curtains found to be most advantageous with walls 34 shown on either side and the outside designated. In this view the major 36" curtains 36 extend from each side with two 27" curtains 38 overlapping each other 5" in the center and overlapping 36" curtains by 3". Centered approximately over the overlap of the 36" curtains 36 and the 27" curtains 38 are 18" curtains 40 which assist in forming a seal to prevent air leakage. Also seen are side curtains 35 which can be utilized between the curtains 36 and wall 34.

Figure 4:
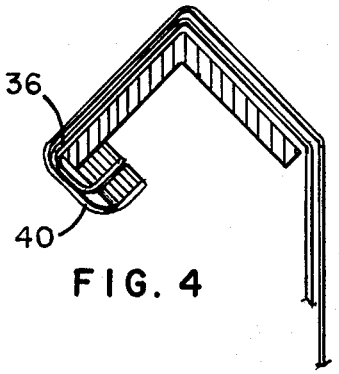
FIG. 4 illustrates a cross-sectional view of the overlapping arrangement of certain curtain segments.

FIG. 4 shows a cross-section when utilizing the overlap system of FIG. 3 showing how the overlapping of curtains and of magnets would form two layers.

Figure 5:
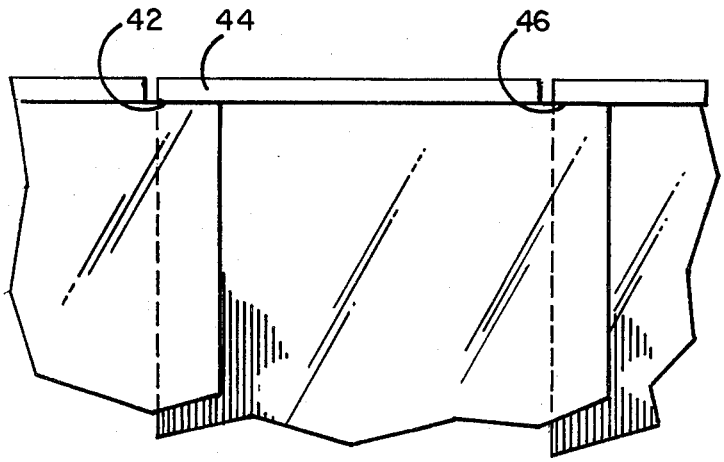
FIG. 5 is a sectional view showing the cutaway areas to allow for minimal overlapping.

FIG. 5 illustrates how to avoid having the 36" curtains 36 and 27" curtains 38 cause a third overlap with the 18" curtains 40 by eliminating sections 42 of the 36" curtain magnet which corresponds to and would overlap the position of the 27" curtain magnet 44 when they are positioned on the angle iron. Also one of the 27" curtain magnets is removed at point 46 so that it may be overlapped by the other 27" curtain magnet without causing a dual layer of magnets. This same procedure is duplicated on the opposite side of the curtain. When the 18" curtain 40 is positioned over the junction of the 36" curtain and the 27" curtain, it only forms a dual layer of magnets as seen in FIG. 4.

Figure 6:
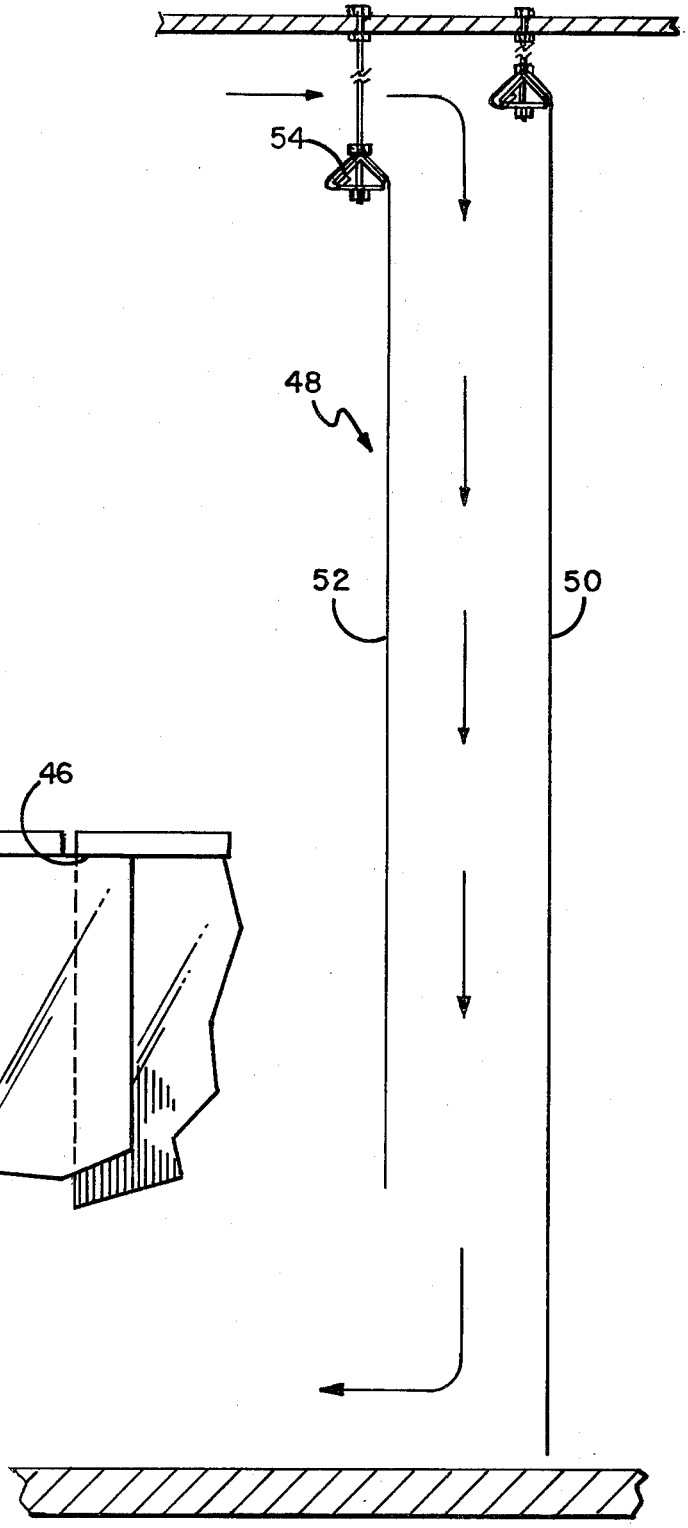
FIG. 6 is a view of the primary and secondary curtains utilized as a thermal siphon.
Figure 7:
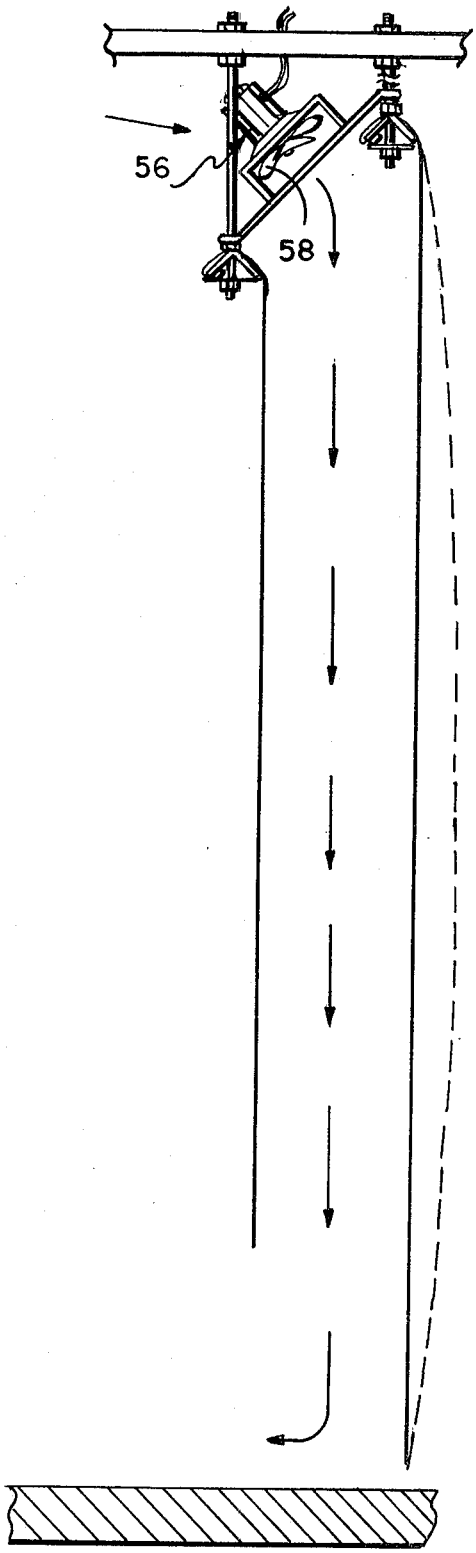
FIG. 7 is a view of a primary and secondary curtain with blower means used as a power destratifier.

FIG. 6 illustrates a passive thermal siphon 48 wherein primary curtain 50 as illustrated in FIG. 3 is backed up by secondary curtain 52 suspended from a similar angle iron 54 in the same fashion as the primary curtain 50. Secondary curtain 52 consists of a plurality of strips 59, for example, in a 10 ft. opening, being 27" strips which extend downward to approximately 2 ft.–3 ft. from the floor, with strips 61 adjacent to the outermost strips extending somewhat higher so that air may pass thereunder faster. The passive system as described above can be reversed in the summertime to allow for the escape of hot air. A power destratification unit 56 as seen in FIG. 7 consisting of a series of fans 58 mounted between the suspension means of the primary and secondary curtains can be added to the passive system. The fans would force air down between the curtains and hence back under the secondary curtain due to the space between it and the floor thereby preventing the escape of this warm air out the primary curtain and thermally balancing the temperature of the garage area as described above.

Figure 8:
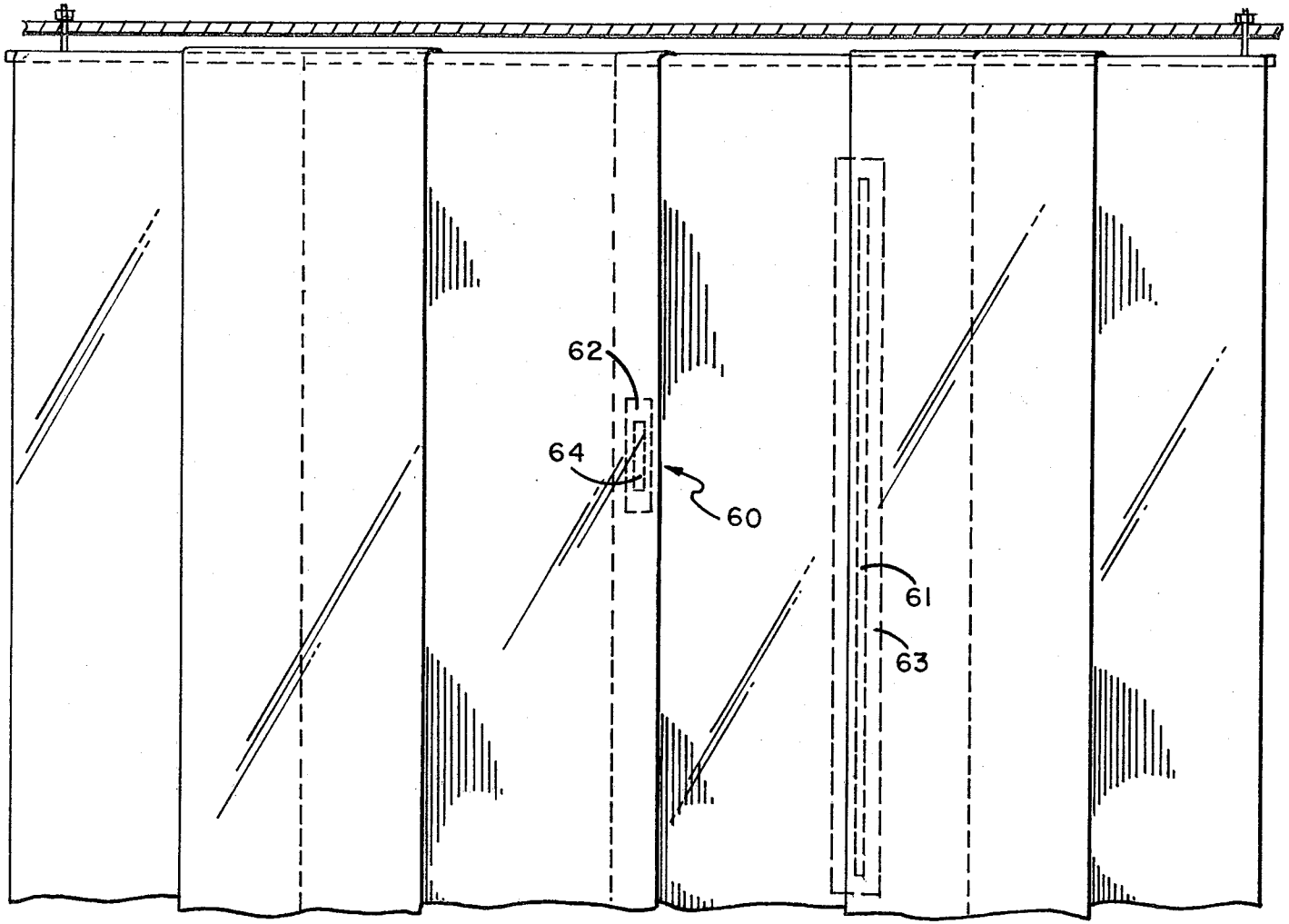
FIG. 8 is a front view of the curtains overlapped having magnetic closure means.

FIG. 8 is a frontal view of the primary curtain showing the overlapping of the strips and also the use of a magnetic latch 60 having a thin magnetically attractive backplate 62 and flexible magnetic front member 64 affixed to an overlapping portion of the curtains so as to be held together except when separated by a moving force. These magnetic latches may be positioned 6 ft. to 7 ft. above the ground level so as to be in the best position to allow for individuals and vehicles to pass through yet still assist in allowing the sheets to come together. More than one magnetic latch can be used. The vinyl sheets also tend to adhere together. The magnetic latch may also extend the length of the curtain as seen by magnetic strips 61 and flexible magnetically attractive base 63 in FIG. 8.

Figure 9:
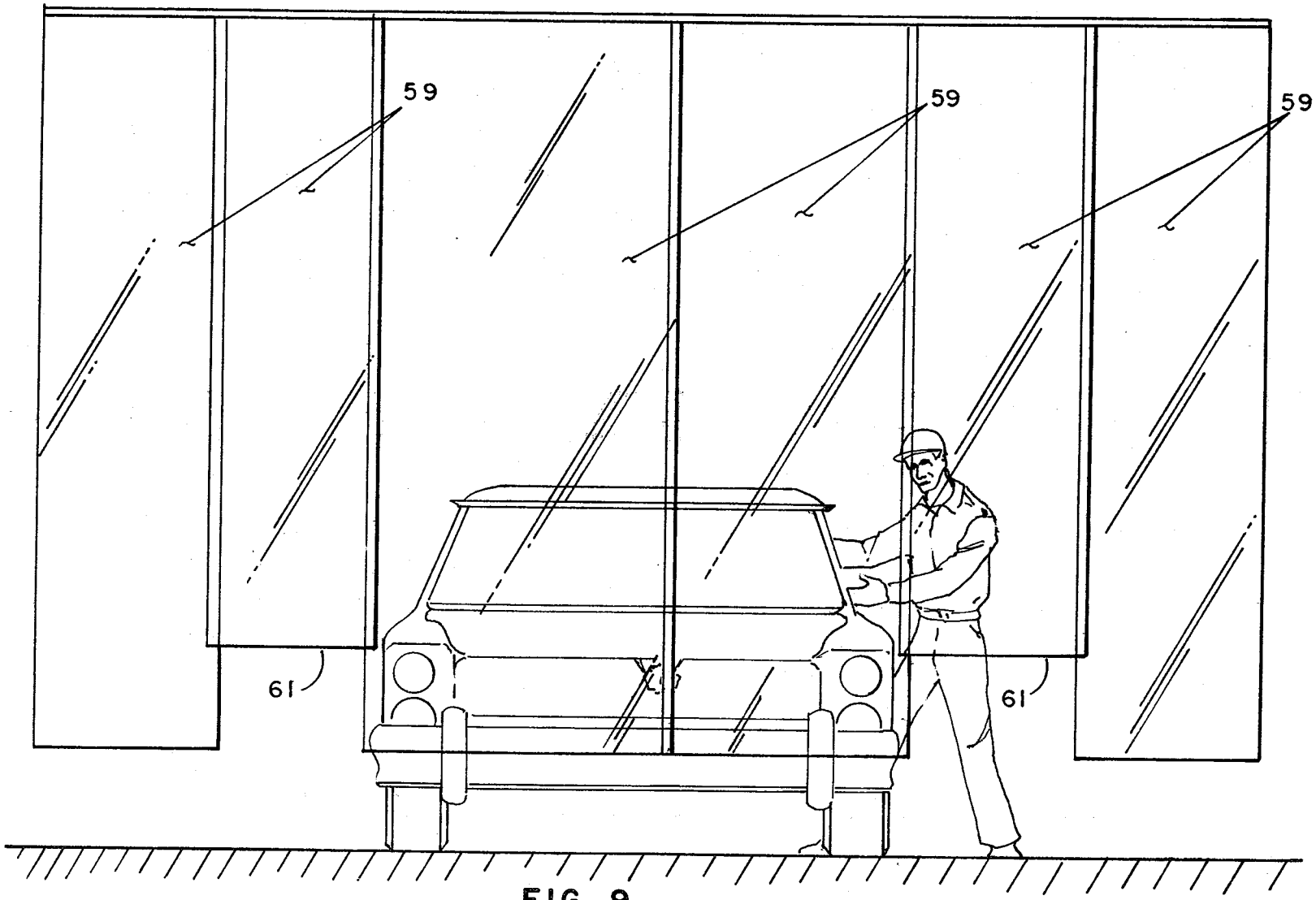
FIG. 9 is a view of a secondary curtain with cutout area for air to be disposed on either side of a vehicle.

FIG. 9 illustrates a front view of secondary curtains 59 wherein the next to outermost curtains 61 are shorter having cutout portions.

Figure 10:
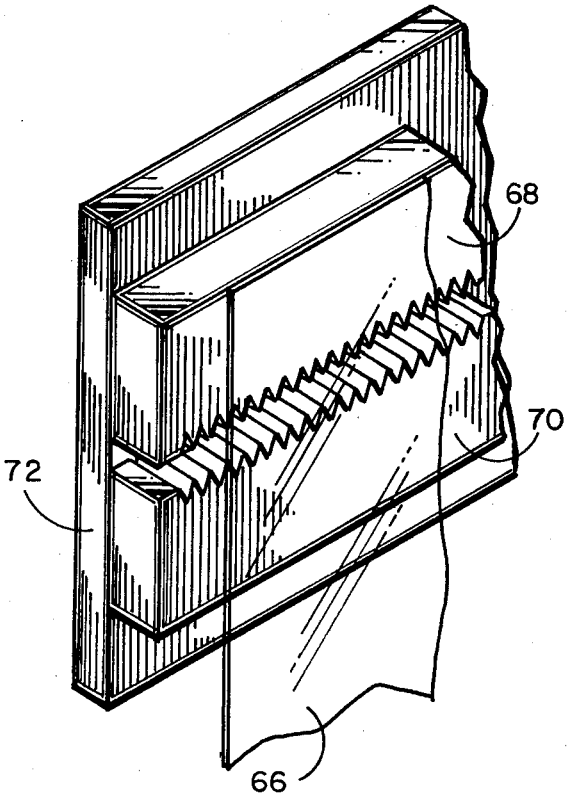
FIG. 10 illustrates the attachment of serated magnetic strips for cabinet closures.

FIG. 10 illustrates a view of the plastic strips utilized on a serated edged magnet 68 adapted to be engaged into a second serated edged magnet 70 mounted on a panel 72 where the strips are to be mounted. This usage is especially advantageous in store freezing cases to prevent cold air from escaping therefrom yet still allow access between the hanging strips to retrieve whatever is desired from within the case. The serated edges of the magnets assist in preventing lateral movement of the strip magnet 68 and also assist in holding the curtain's magnet in position so that the strip magnets 68 and 70 are not easily separated when in use.

Although the present invention has been described with reference to particular embodiments, it will be apparent to those skilled in the art that variations and modifications can be substituted therefor without departing from the principles and spirit of the invention.

We claim:

1. An improved system for the support of curtains utilized as opening closures comprising:

An angle iron support member suspended in an opening in an enclosure having defined therein an area of use with the angle thereof pointing upwards forming a top and its open portion facing downwards having a front downwardly sloping portion and a rear downwardly sloping portion;

a plurality of overlapping curtain member strips positioned over said front portion above said top, down said rear portion and extending to the inside of the rear portion of said angle iron; and a strip magnet affixed to the top of said curtain members adhered by magnetic attraction to the inside of the rear portion of said angle iron.

2. The system of claim 1 wherein said overlapping strips are comprised of two outer 36" strips, two inner 27" strips, said 27" strips overlapping their adjacent 36" strips by 3" and overlapping one another in a central portion thereof by approximately 5" and a first and second 18" strip overlapping the juncture between said 27" strip and the 36" strip forming a primary curtain.

3. The system of claim 2 wherein portions of the strip magnets adhering said strip to said angle iron support member are cut away where said portions overlap with the magnets on other strips.

4. The system of claim 2 further including curtain member strips forming a secondary curtain positioned behind the primary curtain wherein the primary curtain extends to the floor and the secondary curtain is suspended from a position approximately 8"–9" to the rear of the primary curtain and extends downward to approximately 2 ft–3 ft above the floor.

5. The system of claim 4 wherein the strips of the secondary curtain do not overlap and where the bottom portions of each strip adjacent to the outer strip are cutaway higher than the adjacent strips to allow for air to be directed thereunder, said primary and secondary strips forming a passive thermal siphon to allow air which strikes the inside of the first primary strips to be somewhat cooled and to fall downward and pass into the inside of said opening under the secondary strip thereby causing an increase in temperature and destratification of the air within the area of use.

6. The system of claim 4 further utilizing a power destratification means comprised of a series of at least one fan member to force air from the top of the area of use down between the primary and secondary strips and back into the area of use under the secondary strip.

7. The system of claim 6 having a system of thermostats located at the top and the bottom of the area of use controlling the power destratification means wherein when the temperature of the upper thermostat is a predetermined amount higher than the temperature of the lower thermostat, the fan(s) will be activated to balance the thermal content of the area of use.

8. The system of claim 6 or 7 wherein the primary and secondary curtain positions are reversed in the summer to exhaust hot air from the top of the area of use under the secondary curtain now facing outward.

9. The system of claim 3 further including a strip of magnetic material affixed to a first curtain inside a point of overlap with a second curtain and a magnetically attractive material affixed to said second curtain at a point approximating the position of said strip of magnetic material adapted to make contact and be magnetically separably held thereto.

10. The system of claim 9 wherein said magnetic material and magnetically attractive strip extend vertically a substantial length of said curtains.

11. The system of claim 2 further including a pair of angularly disposed side curtains each extending from an outer curtain to a side wall of said opening.

* * * * *